United States Patent [19]

Price

[11] 4,061,095

[45] Dec. 6, 1977

[54] MEANS FOR MOUNTING TUFTING MACHINE HOOKS AND KNIVES

[75] Inventor: Herbert Benjamin Price, Chattanooga, Tenn.

[73] Assignee: Spencer Wright Industries, Inc., Chattanooga, Tenn.

[21] Appl. No.: 727,829

[22] Filed: Sept. 29, 1976

[51] Int. Cl.[2] ..... D05C 15/24

[52] U.S. Cl. ..... 112/79 R; 83/700

[58] Field of Search ..... 112/79 R, 79 A, 78, 112/266, 410, 411; 83/700

[56] References Cited

U.S. PATENT DOCUMENTS

| | | | |
|---|---|---|---|
| 3,604,379 | 9/1971 | Cobble | 112/79 R |
| 3,757,709 | 9/1973 | Cobble | 83/700 X |
| 3,777,852 | 10/1966 | Card | 112/79 R |
| 3,788,245 | 1/1974 | Bonner | 112/79 R |

*Primary Examiner*—H. Hampton Hunter

[57] ABSTRACT

A knife block for mounting a multiplicity of cutting knives in fine gauge cut pile tufting machines. The knife block has an elongated body member with a multiplicity of longitudinally spaced preferably alternately offset holes each receiving a knife supporting peg secured therein with a portion extending from a face of the block. The upstanding portion of each peg has a central web of reduced section and a wedge shaped seat on each side of the web. A tufting machine knife is supported in each seat abutting the web and a cap on the web clamps the knives in the seat.

5 Claims, 4 Drawing Figures

MEANS FOR MOUNTING TUFTING MACHINE HOOKS AND KNIVES

BACKGROUND OF THE INVENTION

This invention relates generally to tufting machines for forming fine gauge cut pile fabric and more particularly to improved knife blocks for mounting the knives in such machines.

In cut pile tufting machines an oscillating knife cooperates with an oscillating hook or looper to cut the loop of yarn that has been seized by the looper from a corresponding needle. It is conventional in such machines for the knife to be supported and retained in a knife block carried by an oscillating knife bar. Examples of the known knife blocks are illustrated in Card, U.S. Pat. No. 3,277,852; Cobble, et al, U.S. Pat. No. 3,386,398; Cobble, U.S. Pat. No. 3,604,379; and Bonner, U.S. Pat. No. 3,788,245. However, each of these knife blocks is limited to mounting one or two knives only.

The gauge of a pile fabric is determined by the spacing between adjacent gauge parts, i.e., the needles, loopers, and knives. Thus, the spacing between each pair of knives mounted in a knife block is the measure of a gauge of the cut pile fabric produced. In fine gauge cut pile fabric, i.e., one tenth gauge and smaller, the spacing between a point on one knife to the corresponding point on an adjacent knife is respectively 0.1 inch and smaller. As a consequence of the close spacing between adjacent knives in fine gauge cut pile machines, great difficulty has been experienced with the use of the knife blocks of the prior art. One solution to this problem is illustrated in copending U.S. patent application of Wear, Ser. No. 683,862.

SUMMARY OF THE INVENTION

The present invention overcomes the problems of the prior art knife blocks by providing a knife block for mounting a multiplicity of knives and which comprises an elongated body member having a multiplicity of holes for receiving a knife supporting peg in each hole, which peg comprises a central web extending from a face of the body member and is formed from a shank secured within the body member, the shank being of larger cross sectional area than the web. The junction between the webs and the shank defines a seat on each side of the web within which a knife is positioned on edge and held in place by a cap positioned to engage another edge of the knife. In the preferred embodiment, the junction between the web and the shank is wedge shaped and alternate pegs are laterally offset one from the other. The unique pegs thus allows the close spacing required for fine gauge tufting machines. It, moreover, allows the assembly of a multiplicity of knives in a single body member and allows for rapid assembly and disassembly of the knives in the tufting machine.

It is, therefore, a primary object of the present invention to provide an improved knife block for cut pile tufting machines for mounting a multiplicity of cutting knives.

It is another object of this invention to provide a knife block for cut pile tufting machines having an elongated body member including a multiplicity of laterally spaced holes for receiving knife supporting pegs, with each peg having a shank and a web of reduced cross section relative to the shank such that the junction between the shank and the web defines a knife receiving seat in which a knife is positioned on edge and held in place by a cap engaging the web and the other edge of the knife to clamp the knife in the seat.

BRIEF DESCRIPTION OF THE DRAWINGS

The particular features and advantages of the invention as well as other objects will become apparent from the following description taken in connection with accompanying drawings, in which.

DETAILED DESCRIPTION OF THE PREFERRED EMBODIMENT

Figure 1:
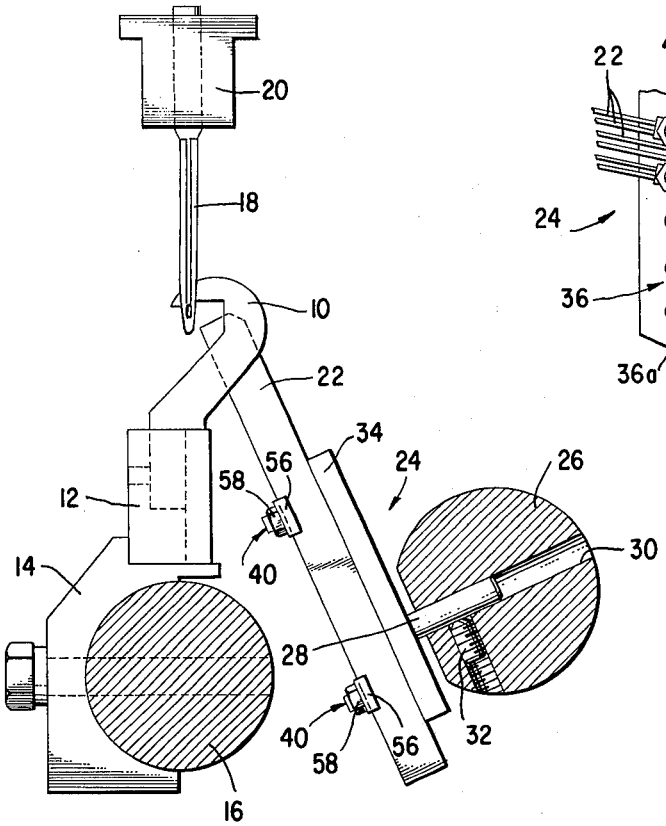
FIG. 1 is a side sectional elevational view taken through a portion of a conventional cut pile tufting machine, and disclosing a knife block incorporating the present invention.

Referring to FIG. 1, a tufting machine hook or looper 10 is illustrated as being supported in a looper block 12 which is in turn supported by a block support 14. The block support 14 is suitably bolted to a rock shaft 16 for rocking the looper 10 back and forth, for picking up a loop of yarn from a needle 18 supported in a needle bar 20 in a known manner. In cut pile machines, the looper 10 is generally rocked or oscillated into position for cooperating with a knife mechanism in timed relationship for cutting the loop of yarn to form cut pile.

In order to carry out this objective, a plurality of cutting knives 22 are carried by a series of knife blocks generally indicated at 24. Each knife block in turn is supported on a rock shaft 26 by means of a support shaft or stud 28 integral with the block and received within a bore 30 within the shaft 26 and secured by a set screw 32 or the like. The knife blocks are thus oscillated by the rock shaft 26 back and forth into cutting engagement with the yarn on the looper.

Figure 2:
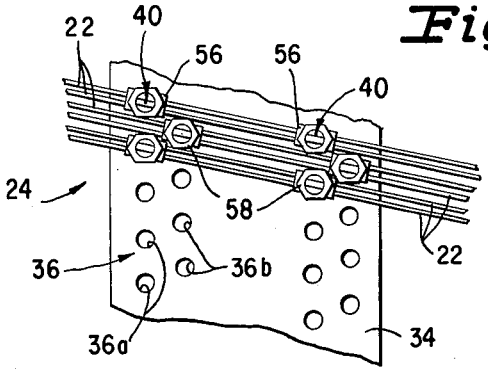
FIG. 2 is a plan view of a portion of the knife block illustrated in FIG. 1.
Figure 3:
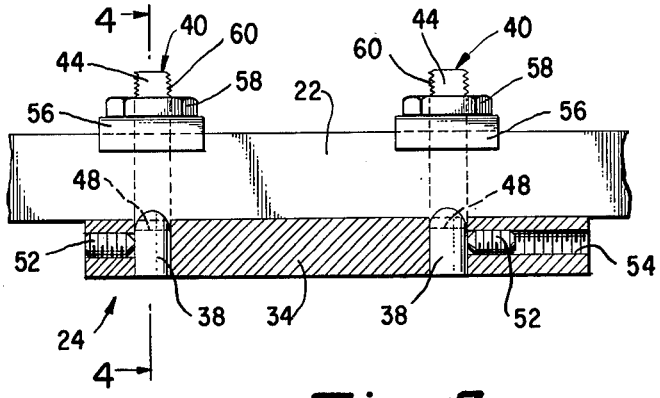
FIG. 3 is a sectional view through the knife block illustrating the mounting of a knife therein.
Figure 4:
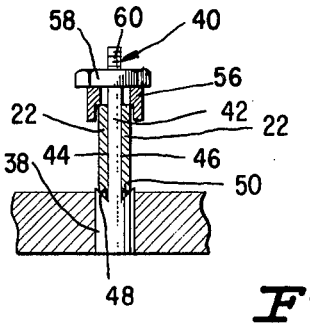
FIG. 4 is a sectional view taken substantially along lines 4—4 of FIG. 3.

Referring now to FIGS. 2 through 4, it will be seen that a knife block 24 constructed in accordance with the present invention comprises an elongated body support member 34 preferably of a rectangular form having its longitudinal axis extending laterally of the tufting machine and substantially parallel to the axes of the shafts 16 and 26. There may be any convenient number of such members 34 across the machine with each having at least one mounting stud 28. The exact number of support members 34 will depend on the width of the machine, the gauge and the number of knives most economically carried by each of the members.

At best illustrated in FIG. 2, formed in the longitudinally extending faces of the support member 34, are a multiplicity of holes 36 spaced apart longitudinally by an amount equivalent to the desired gauge. For fine gauge, alternate longitudinally adjacent holes may be offset laterally as illustrated at **36*a* and 36*b*. The holes may be drilled at an angle to the face of the support member to provide the knives with the proper canter for cutting as is conventional. It is, moreover, preferable to have two such holes in each lateral row each for receiving the shank 38 of a knife supporting peg 40**. The holes in each lateral row being located so that the knives are disposed at an angle to the plane of the needles as is also conventional.

The peg 40 includes a substantially central web portion 42 extending outwardly from the support member 34 having substantially flat planar surfaces 44 and 46 on either side thereof. On each side of the web at the junction of the respective web surfaces 44 and 46 with the shank 38, a knife receiving seat 48 and 50 is defined. Preferably each seat is wedged shaped and has a surface inclined from the outer surface or border of the shank inwardly toward the web and downwardly toward the major portion of the peg shank and the support member 34. Each peg 40 may be secured in the member 34 by means of a set screw 52 positioned in a tapped bore 54 formed in the support member 34.

Located in each seat 48 and 50 and against the respective surface 44 and 46, is one of the knives 22. The knife rests on one of its edges within the seat and a face thereof abuts the web. In order to secure the knives within the seat, a cap 56 is positioned on the other edge of the knife and is secured to the web by conventional means such as a nut 58 threaded onto a threaded or serrated top portion 60 of the web. Preferably, the caps are positioned to abut the two knives seated on each peg and may have a flange 62 and 64 extending downwardly toward the shank 38 parallel to the web on a respective side thereof. The flanges aid in providing lateral support to the knives and makes the construction more rigid.

Since each peg 40 requires a minimum of lateral and longitudinal space for mounting of two knives especially when the holes 36 are staggered laterally as illustrated, the present invention provides a knife mounting arrangement which allows a very fine gauge knife spacing and aids in replacement of worn knives.

It should thus be clear that a simple and inexpensive knife mounting arrangement is disclosed in this application. Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what we heretofore claim is:

1. A knife block for a tufting machine supporting a multiplicity of laterally spaced knives each having a substantially rectangular body including two opposite longitudinal edges extending between two opposite faces terminating at a cutting surface at one end, said knife block comprising an elongated body member having a multiplicity of holes formed in a face thereof, a knife supporting peg having a shank received in each hole and extending from said face, at least a portion of the peg extending from the hole comprising a central web of reduced thickness from that of the shank, the width of said webs being substantially no greater than that of said shank, a seat formed in the shank at each side of the web, a knife edge positioned in each seat with a face abutting the web, a cap positioned on the web and the other edge of each knife, and means for drawing said cap into locking engagement with said knives to secure the knives to the block.

2. A knife block as recited in claim 2 wherein each of the seats are wedge shaped inclined inwardly toward the web and the block from the margin of the shank.

3. A knife block as recited in claim 1 wherein said cap includes a flange on each side of and extending substantially parallel to said web on the other side of the knife and facing toward said block.

4. A knife block as recited in claim 1 wherein the holes receiving laterally adjacent pegs are offset one from the other.

5. A knife block as recited in claim 1 wherein the holes in said body member are disposed in a plurality of laterally spaced rows, each row comprising at least two spaced holes, each knife being supported by at least two spaced pegs.

* * * * *